US006153016A

United States Patent [19]

Rauch et al.

[11] Patent Number: 6,153,016

[45] Date of Patent: Nov. 28, 2000

[54] PIPE THREAD CLEANER

[75] Inventors: David J. Rauch; Robert A. Cole; Shahzad Mahmud, all of San Jose, Calif.

[73] Assignee: Creative Tool Technology, Inc., San Jose, Calif.

[21] Appl. No.: 09/206,814

[22] Filed: Dec. 7, 1998

[51] Int. Cl.[7] ..... B08B 1/00

[52] U.S. Cl. ..... 134/6; 15/104.04; 15/88

[58] Field of Search ..... 15/88, 160, 104.03, 15/104.04; 134/6, 8, 22.11, 23

[56] References Cited

U.S. PATENT DOCUMENTS

| | | | |
|---|---|---|---|
| 2,225,272 | 12/1940 | Horne | 15/88 |
| 2,508,291 | 5/1950 | Porro | 15/104.04 |
| 4,014,062 | 3/1977 | Scott et al. . | |
| 4,403,363 | 9/1983 | Hess . | |
| 4,433,448 | 2/1984 | True . | |
| 4,593,451 | 6/1986 | Roberts . | |
| 4,663,794 | 5/1987 | Evans | 15/104.04 |
| 5,070,569 | 12/1991 | Wilkins | 15/160 |
| 5,146,717 | 9/1992 | Shemesh et al. | 15/104.04 |
| 5,157,802 | 10/1992 | Guidry et al. . | |
| 5,946,757 | 9/1999 | Oliveira | 15/104.04 |

FOREIGN PATENT DOCUMENTS

| | | | |
|---|---|---|---|
| 2671745 | 7/1992 | France | 15/160 |
| 1335346 | 9/1987 | U.S.S.R. | 15/104.03 |

*Primary Examiner*—Terrence R. Till

*Attorney, Agent, or Firm*—Skjerven Morrill MacPherson LLP

[57] ABSTRACT

A pipe cleaner for manually cleaning the threads of pipes of differing sizes includes a body into which is slidably engaged at least one arm with an abrasive member. The abrasive member at the end of the arm extends into an orifice in the body. A single arm opposing a "V" shaped block may be used as well as a plurality of arms with abrasive members. A cover is rotatably mounted on the body and includes a number of angled slots, which are angled relative to radii of the cover and may be an arc segment of a spiral. Pegs that are coupled to each arm are engaged with the angled slot in the cover. Thus by rotating the cover relative to the body of the pipe cleaner, the arms with their abrasive members are driven inwards and outwards of the orifice by the peg and angled slot assembly. The cover includes an orifice that is approximately the same size as the orifice in the body, such that the cover does not inhibit a pipe from extending through the pipe cleaner. The body of the pipe cleaner may alternatively include opposing jaws upon which are mounted, respectively, a "V" shaped block and a beam having an abrasive member. The jaws pivot to adjust the position of the abrasive member relative to the "V" shaped block so as to accommodate pipes of various diameters.

10 Claims, 7 Drawing Sheets

PIPE THREAD CLEANER

FIELD OF THE INVENTION

The present invention relates to an apparatus for cleaning threads of a pipe, and in particular to a hand held apparatus for cleaning external pipe threads.

BACKGROUND

Pipes, such as that used in plumbing connections, are equipped with threads typically on the outside of each end. To ensure a tight seal between a pipe and an element to which the pipe is being connected, the threads of the pipe are often covered with teflon tape or the like. Upon removal of the pipe from its connection, the teflon tape is often embedded within the threads of the pipe. Generally, before reconnecting the pipe, the used teflon tape must be removed because it will interfere with a good seal between the pipe and the element to which the pipe is being connected. Once the used teflon tape is removed from the threads of the pipe, the threads of the pipe can then be covered with fresh teflon tape to ensure a connection with a tight seal.

The threads of a pipe are conventionally cleaned using a wire brush, steel wool, or similar type abrasive material. The threads of the pipe are manually scrubbed, for example, by the wire brush, until the used teflon tape has been removed from the threads. Scrubbing the threads of a pipe with a wire brush can be time consuming because the wire brush can only contact a small area of the threads at any one time. Moreover, a wire brush may be difficult to use because the wire brush must be scrubbed back and forth while maintaining firm pressure against the threads of the pipe. While steel wool conforms to the shape of the pipe, the steel wool is not as effective at cleaning the threads.

Thus, there is a need for a hand held tool that conveniently and easily cleans the threads of pipes with differing diameters.

SUMMARY

A pipe cleaner for manually cleaning the threads of pipes of differing sizes includes a body with a plurality of grooves into which are slidably engaged corresponding arms, each with an abrasive member. The abrasive members at the end of each arm extend into an orifice in the body such that when a pipe is inserted into the orifice, the abrasive members contact the threads of the pipe. A cover is rotatably mounted on the body. The cover includes a plurality of angled slots, which are angled relative to perimeter of the cover. Pegs that are coupled to each arm are engaged with the angled slots in the cover. Thus, by rotating the cover relative to the body of the pipe cleaner, the arms with their abrasive members are driven inwards and outwards of the orifice by the peg and angled slot assembly, thereby permitting the pipe cleaner to be used on pipes having differing diameters. The cover includes an orifice that is approximately the same size as the orifice in the body, such that the cover does not inhibit a pipe from extending through the pipe cleaner. In a preferred embodiment, three arms with abrasive members are used so that the pipe being cleaned is held firmly between the abrasive members. The abrasive members may wire brushes, such as nylon or brass wire brushes, or steel wool or similar type abrasive material.

The cover is rotatably mounted by fastener elements, such as bolts, rivets, or screws, that extend through arcuate slots in the cover and are engaged in bores in the body. Alternatively, bevel shaped arms and grooves may be used to mount the cover. The cover is mounted to the arms via the pegs that are coupled to each arm and extend through the angled slots in the cover. A detent mechanism may be used to prevent unintentional rotation of the cover relative to the body.

By rotating the cover relative to the body, the arms with their abrasive members are driven inward and outwards of the orifice. Consequently, pipes of differing diameters may be accommodated by the pipe cleaner. Once the pipe is inserted into the orifice and the abrasive members are in contact with the threads of the pipe, the threads may be easily and conveniently cleaned by rotating the pipe and the pipe cleaner relative to each other.

In other embodiments, a single arm with an abrasive element may be adjusted relative to an opposing "V" shaped block to accommodate pipes of differing diameters. In addition, the "V" shaped block and a beam having an abrasive member may be integrally or removably mounted on opposing jaws on a pipe cleaner. The jaws of the pipe cleaner can then be adjusted relative to one another so as to accommodate pipes of differing diameters, as well as to place the abrasive member in firm contact with the threads of a pipe.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
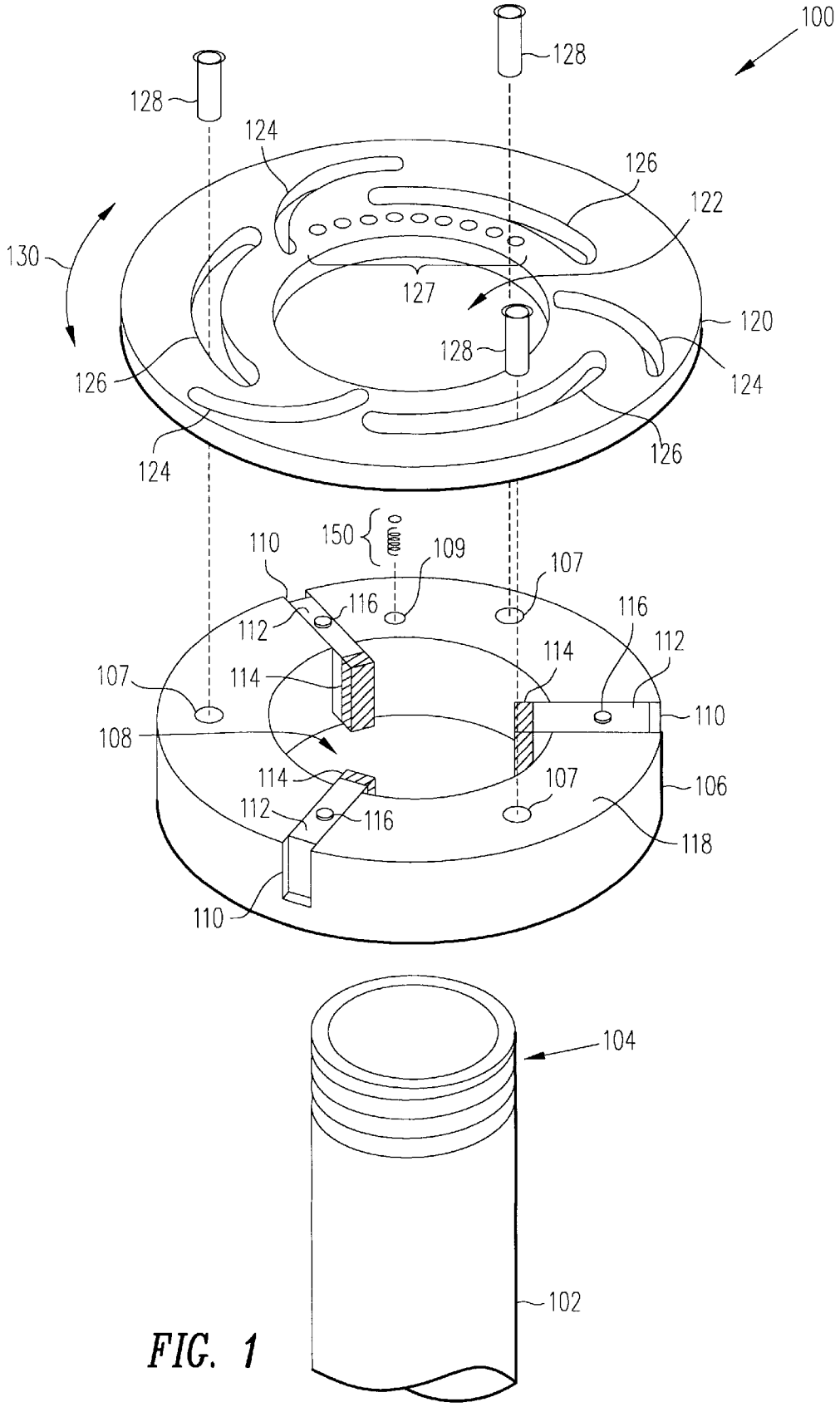
FIG. 1 is an exploded perspective view of a pipe cleaner in accordance with an embodiment of the present invention.

FIG. 1 is an exploded perspective view of a pipe cleaner 100 in accordance with an embodiment of the present invention, positioned over a pipe 102 having external threads 104 at an end.

Pipe cleaner 100 includes a body 106 having a central orifice 108 and a plurality of grooves 110. In one embodiment of the present invention, the body 106 has a toroidal shape, with orifice 108 being the center of the toroid. Grooves 110 extend from the inside diameter of the body 106, i.e., from the orifice 108, to the outside diameter of the body 106. Body 106 also has a plurality of bores 107 into which corresponding fastener elements 128 are coupled. In addition, body 106 includes a detent bore 109 into which detent mechanism 150 is engaged, as is discussed in more detail in reference to FIG. 5 below.

Arms 112 are slidably engaged in corresponding grooves 110. At the end of each arm 112 that extends into orifice 108 is an abrasive member 114, such as wire brushes, steel wool, or any other similar type abrasive member. The arms 112 slide through grooves 110 permitting pipe cleaner 100 to be used with different sized pipes 102. At the top of arms 112 are pegs 116, which extend upward beyond the top surface 118 of body 106.

Pipe cleaner 100 also includes a cover 120 that is rotatably mounted on the top surface 118 of body 106. Cover 120 has a central orifice 122, which is aligned with orifice 108 in body 106. In addition, cover 120 has a plurality of angled slots 124. Angled slots 124 are angled relative to the perimeter of cover 120. Each angled slot 124 corresponds to an associated peg 116 on arms 112. Thus, when cover 120 is seated on the top surface 118 of body 106, each peg 116 is engaged in a corresponding angled slot 124.

Cover 120 also includes a plurality of arcuate slots 126 that are concentrically positioned such that they are the same distance from orifice 122. Fastener elements 128 extend through arcuate slots 126 and into bores 107 thereby rotatably mounting cover 120 onto the top surface 118 of the body 106. Fastener elements 128 are bolts, pins, screws, rivets or any similar type of devices, which securely affix cover 120 to body 106, while permitting cover 120 to rotate relative to body 106, as indicated by arrow 130. In addition, cover 120 includes a plurality of holes 127 into which detent mechanism 150 engages to prevent rotation of cover 120 relative to body 106.

With cover 120 mounted on body 106, pegs 116 are engaged in corresponding angled slots 124. When cover 120 is rotated relative to body 106, pegs 116 will slide within angled slots 124 to drive arms 112 inward and outward. As shown in FIG. 1, when cover 120 is rotated in a clock wise direction relative to body 106, arms 112 will be driven inward due to the engagement of pegs 116 and angled slots 124. Thus, cover 120 can be rotated such that the arms 112 and abrasive members 114 are suitably adjusted to accept pipe 102. Detent mechanism 150 is used prevent cover 120 from rotating from a desired position relative to body 106. With the abrasive members 114 on arms 112 in contact with the threads 104 of pipe 102, the pipe cleaner 100 can then be rotated relative to pipe 102 to clean threads 104.

It should be understood that while FIG. 1 shows three arms 112 with pegs 116 and corresponding angled slots 124, the specific number shown is exemplary and not intended as a limitation. While three arms 112 are advantageous to hold the pipe being cleaned firmly between abrasive members 114, fewer or additional arms 112 may be used if desired. Moreover, if desired, fewer or additional fastener elements 128 may be used.

Figure 2A:
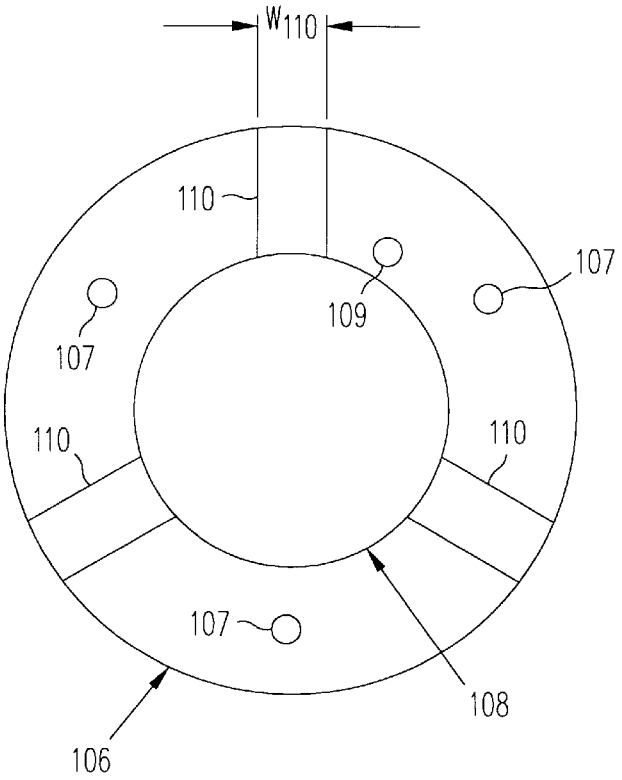
FIGS. 2A and 2B show a top plan view and a side view, respectively, of a body of the pipe cleaner shown in FIG. 1.
Figure 2B:
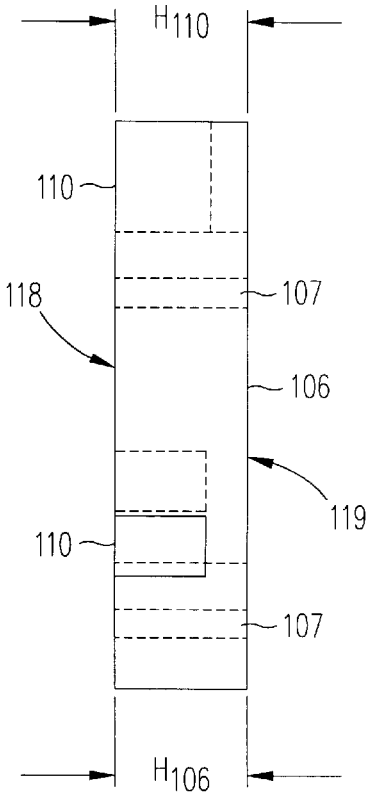

FIGS. 2A and 2B show a top plan view and a side view, respectively, of body 106. Body 106 is manufactured, by way of example, from molded or extruded plastic, wood, die cast or machined aluminum, or other similar manufacturing process of an appropriately rigid material. While body 106 can be any size, it is desirable that body 106 is large enough to accommodate a large range of pipe sizes and yet remain sufficiently small as to be hand held. By way of an example, body 106 can have an outside diameter of 4.5 in. and an inside diameter of 2.5 in., defining orifice 108. An inside diameter of 2.5 in. will accommodate pipes having a diameter of approximately 2.5 in. and smaller, which is a typical size of pipes used in plumbing. Of course, body 106 can have larger dimensions to accommodate larger pipes. As illustrated in FIG. 2B, body 106 has a thickness $H_{106}$ of approximately 1 in., but this dimension may also be altered so that body 106 is adequately rigid and has sufficient room to accommodate arms 112 in grooves 110.

As illustrated in FIG. 2A, grooves 110 have a width $W_{110}$ of approximately 0.51 in. and extend from the outside diameter of body 106 to the inside diameter of body 106. It should be understood, of course, that with the proper dimensioning of body 106, i.e., a smaller inside diameter or larger outside diameter, grooves 110 may not necessarily extend to the outside diameter of body 106. However, if grooves 110 do not extend to the outside diameter of body 106, arms 112, which are slidably engaged in grooves 110 may be limited in their mobility, thereby limiting the size of pipe that pipe cleaner 100, may accommodate. Grooves 110 are ideally positioned equidistantly from each other. Thus, where three grooves 110 are used, as shown in FIGS. 2A and 2B, they are positioned 120 degrees from one another. As shown with dashed lines in FIG. 2B, grooves 110 extend downward from the top surface 118 of body 106 and have a thickness $H_{110}$ of approximately 0.76 in. Of course, the specifically described dimensions of grooves 110 may be altered. Further, altering the dimensions of grooves 106 may be particularly desirable if the dimensions of body 106 itself are altered.

Body 106 also includes a plurality of bores 107, as shown in FIG. 2A and FIG. 2B (illustrated with dashed lines). Bores 107 have a diameter of approximately 0.25 in., and should be large enough to accommodate fastener elements 128 (shown in FIG. 1). Bores 107 are positioned at a radius of approximately 1.9 in. from the center of body 106, and extend from the top surface 118 of body 106 to the bottom surface 119 of body 106.

In addition, body 106 includes a detent bore 109 into which a detent mechanism 150 may be engaged. Detent bore 109 is approximately 0.25 in. in diameter, 0.85 in. deep, and at a radius of 1.5 in. from the center of body 106.

Figure 3A:
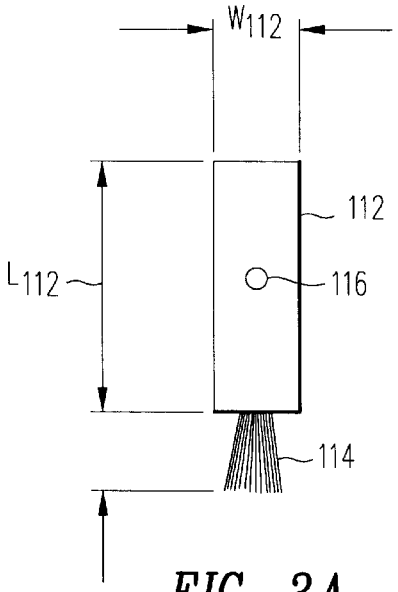
FIGS. 3A and 3B show a top plan view and side view, respectively, of a single arm with abrasive member used in conjunction with an embodiment of the pipe cleaner of the present invention.
Figure 3B:
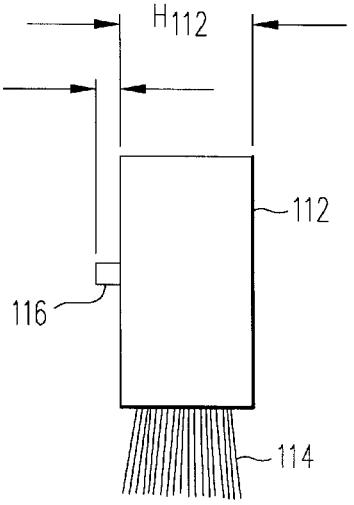

FIGS. 3A and 3B show a top plan view and side view, respectively, of a single arm 112 with abrasive member 114. It should be understood that all arms used in conjunction with body 106 are similar in size and manufacture to the single arm 112 shown in FIGS. 3A and 3B.

Arm 112 is manufactured from plastic, wood, or aluminum or other similarly rigid material. Arm 112 is dimensioned to fit in grooves 110 such that arm 112 may slide back and forth. Thus, arm 112 has a width $W_{112}$ of approximately 0.50 in. and a thickness $H_{112}$ of approximately 0.75 in. These dimensions of course may be altered along with the dimensions of grooves 110. The length $L_{112}$ of arm 112 is approximately 1.50 in. Peg 116 is integrally formed on arm 112 and has a diameter of approximately 0.125 in. and has a thickness of approximately 0.125 in. Of course, alternately peg 116 may be mounted on arm 112, for example, as the head of a screw, bolt, rivet, pressed in pin, or similar device.

Abrasive member 114 is a wire brush, such as brass, steel, or nylon, with a length $L_{114}$ of approximately 0.50 in.

Abrasive member 114 may alternatively be steel wool or other similar bristleless type abrasive member. Abrasive member 114 may be integrally or removably mounted on arm 112. For example, abrasive member 114 may be mounted on arm 112 with a screw.

Figure 4:
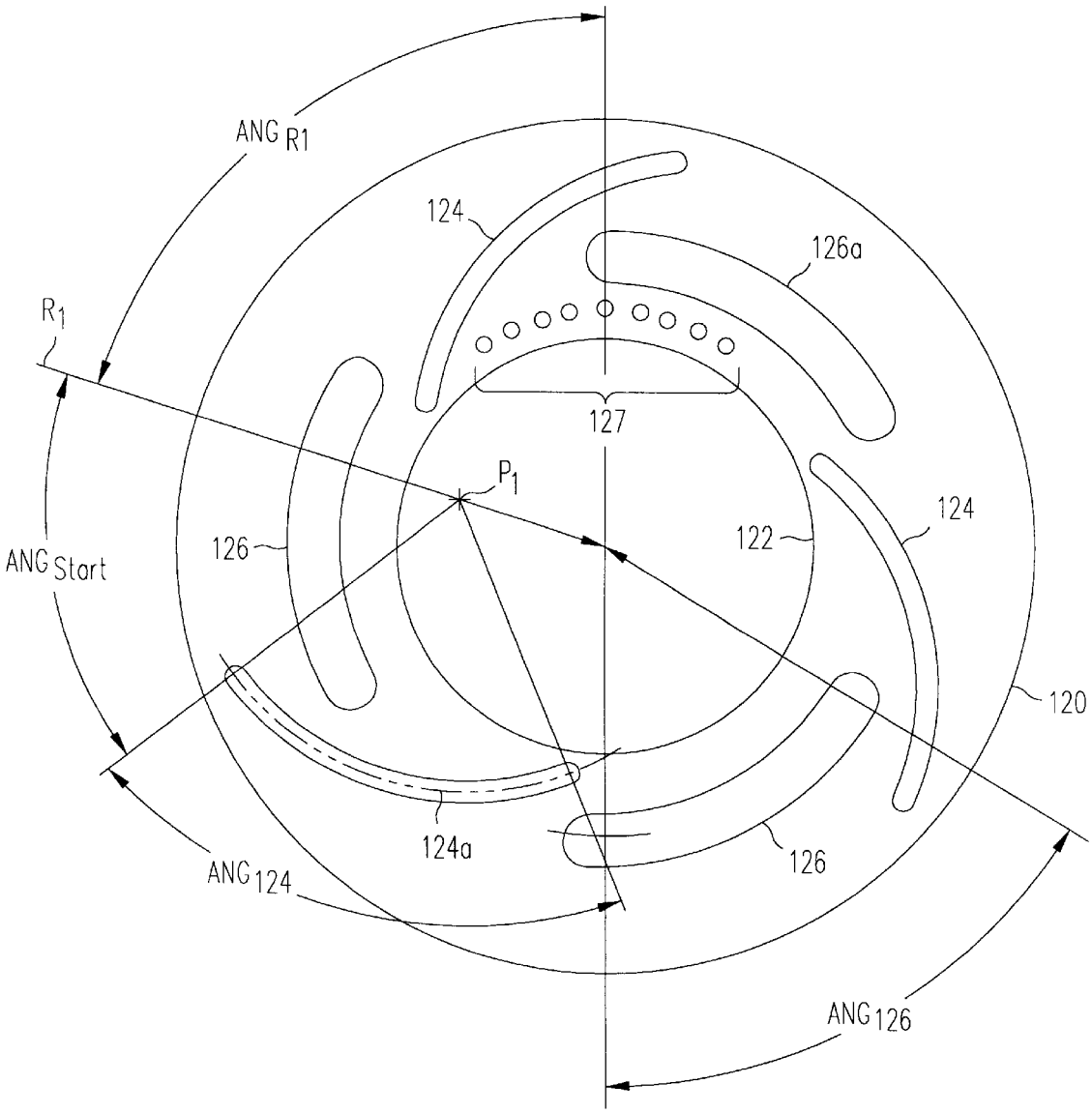
FIG. 4 shows a top plan view of a cover of the pipe cleaner shown in FIG. 1.

FIG. 4 is a top plan view of cover 120. Cover 120 is manufactured, by way of example, from molded plastic or can be stamped, die cast, or machined aluminum, steel, or other similar rigid material. Cover 120 has an outside diameter that is slightly larger than the outside diameter of body 106, e.g., approximately 5.0 in., and an inside diameter defining orifice 122 that is the approximately the same size as the inside diameter of body 106, e.g., 2.50 in. Cover 120 has a thickness of approximately 0.80 in. so that cover 120 is sufficiently rigid.

Cover 120 includes a series of holes 127 into which detent mechanism 150 engages. Holes 127 are aligned with detent bore 109, and thus are approximately 1.5 in. from the center of cover 120. Holes 127 are evenly spaced across 60 degrees of cover 120 and are approximately 0.188 in. in diameter. Holes 127 extend through cover 120, but alternatively, may be mere indentations in cover 120 when a ball and spring type detent mechanism 150 is used.

Cover 120 includes three arcuate slots 126, which are aligned with bores 107 in body 106. Arcuate slots 126 are approximately 0.26 in. wide and are positioned at a radius of approximately 1.9 in. from the center of cover 120. As illustrated in FIG. 4 arcuate slots 126 have an angle $ANG_{126}$ of approximately 60 degrees. Because there are three equidistant arcuate slot 126 shown in FIG. 4, where each arcuate slot 126 is 60 degrees, each arcuate slot 126 is also 60 degrees from another arcuate slot. Fastener elements 128 (shown in FIG. 1) extends through arcuate slots 126 and into bores 107, thereby mounting cover 120 to body 106. In one embodiment of the present invention, fastener elements 128 are releasable so that cover 120 may be removed from body 106. The ability to remove cover 120 from body is advantageous as it permits access to arms 112 so that arms 112 and/or abrasive members 114 may be replaced.

Cover 120 also includes angled slots 124, which engage pegs 116 on arms 112. Angled slots 124 are approximately 0.13 in. wide. Angled slots 124 may be straight or curved, but should be angled relative to a radius extending from the center of cover 120 to ensure that arms 112 are driven inward and outward as cover 120 is rotated relative to body 106. As shown in FIG. 4, an angled slot 124*a* is positioned relative to an arcuate slot 126*a* on the opposite side of body 106. A radius $R_1$ that extends from the center of cover 120 is projected at an angle $ANG_{R1}$, approximately 82 degrees, from one end of arcuate slot 126. A center for angled slot 124*a* is formed at a point $P_1$ along radius $R_1$ that is approximately 0.9089 in. from the center of cover 120. Angled slot 124*a* is formed at a radius of 1.7502 in from point $P_1$ and is formed at an angle $ANG_{START}$ of approximately 57 degrees. Angled slot 124*a* has an angle $ANG_{124}$ of approximately 72 degrees. The remaining angled slots 124 on cover 120 are positioned in a similar manner. It should be understood that this is merely one way of positioning angled slots 124 and that many other ways of positioning angled slots, with different dimensions and angles, can be used as is well understood by those of ordinary skill in the art. For example, each arcuate slot 124, for example, may be an arc segment of a separate spiral.

Figure 5:
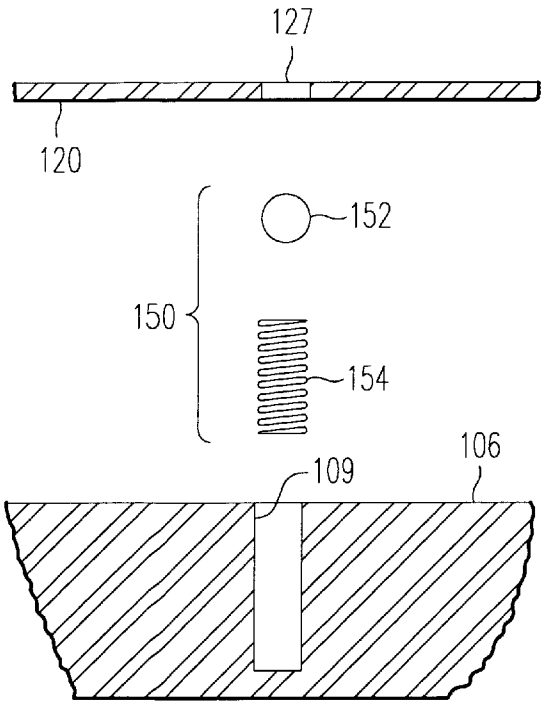
FIG. 5 shows a side view of a detent mechanism used in conjunction with an embodiment of the pipe cleaner of the present invention.

FIG. 5 is a side view of an embodiment of detent mechanism 150. Detent mechanism 150 includes a ball 152 and a spring 154. Spring 154 and a portion of ball 152 are engaged in bore 109 in body 106. The top portion of ball 152 is forced into hole 127 in cover 120, thereby preventing cover 120 from unintentionally rotating. Of course, if desired, hole 127 could be an indentation in cover 120 as opposed to a hole through cover 120.

Figure 6B:
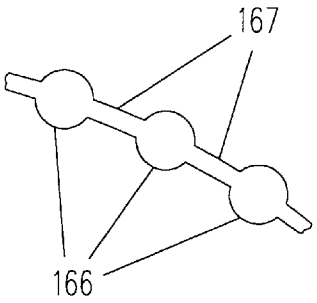
FIGS. 6A and 6B show a side view of a detent mechanism and the associated holes in the cover used in conjunction with another embodiment of the pipe cleanser of the present invention.
Figure 6A:
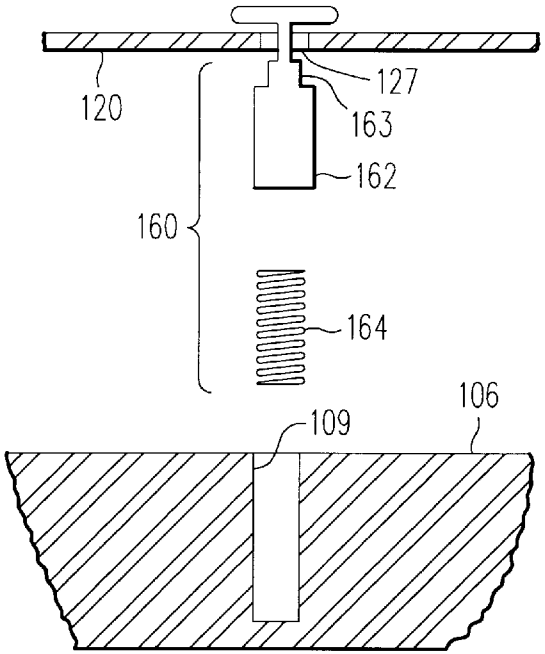

FIGS. 6A and 6B show a side view of another embodiment of a detent mechanism. Detent mechanism 160, shown in FIG. 6A, includes a locking button 162 and a spring 164. Spring 164 and the bottom portion of locking button 162 engage with detent bore 109. Spring 164 biases a shoulder 163 of locking button 162 into a hole 166 in cover 120. FIG. 6B shows several holes 166 in cover 120. As shown in FIG. 6B, holes 166 are connected via a slot 167. Thus, when locking button 160 is pressed downward, shoulder 163 is disengaged from hole 166 such that cover 120 may be rotated. When locking button 160 is released, shoulder 163 will engage with hole 166 preventing cover 120 from rotating.

Of course, the detent mechanisms shown in FIGS. 5, 6A and 6B are exemplary, and other types of detent mechanisms may be used. For example, a screw or bolt may extend through hole 127 in cover and screw into detent bore 109.

Alternatively, detent mechanism 150 is not used to secure the rotational position of cover 120 relative to body 106. In such an embodiment, fastener elements 128 may tightly engage cover 120 to body 106 such that friction prevents cover 120 from rotating. Additionally, the rotation of cover 120 in a clock wise direction can be used while cleaning the threads of a screw to drive arms 112 with abrasive members 114 inward and into contact with the threads 104 of the pipe 102.

Figure 7:
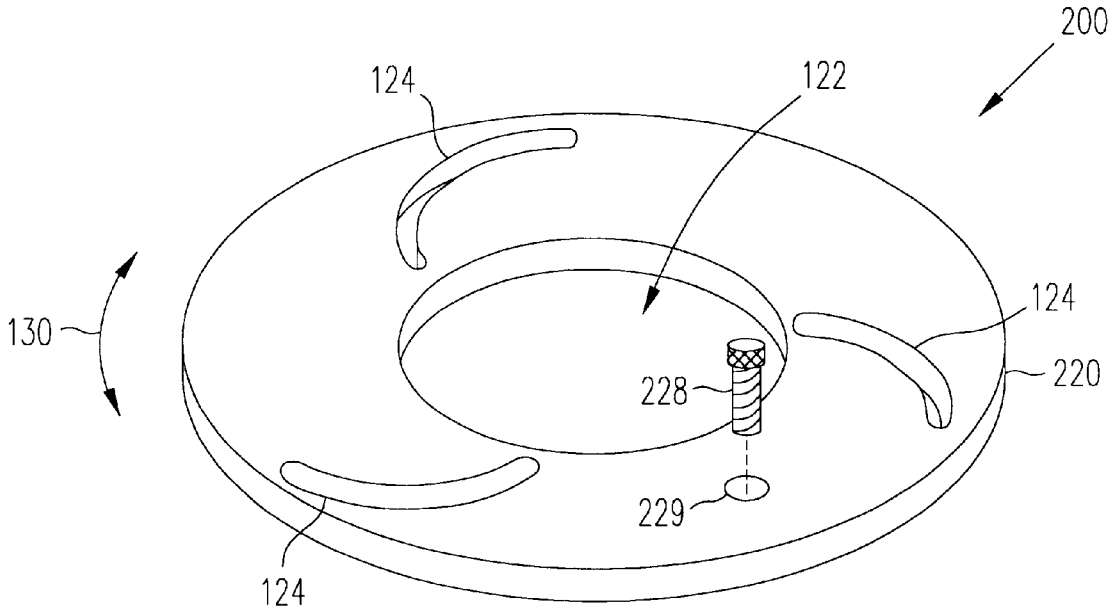
FIG. 7 is a top perspective view of a pipe cleaner in accordance with another embodiment of the present invention.
Figure 7:
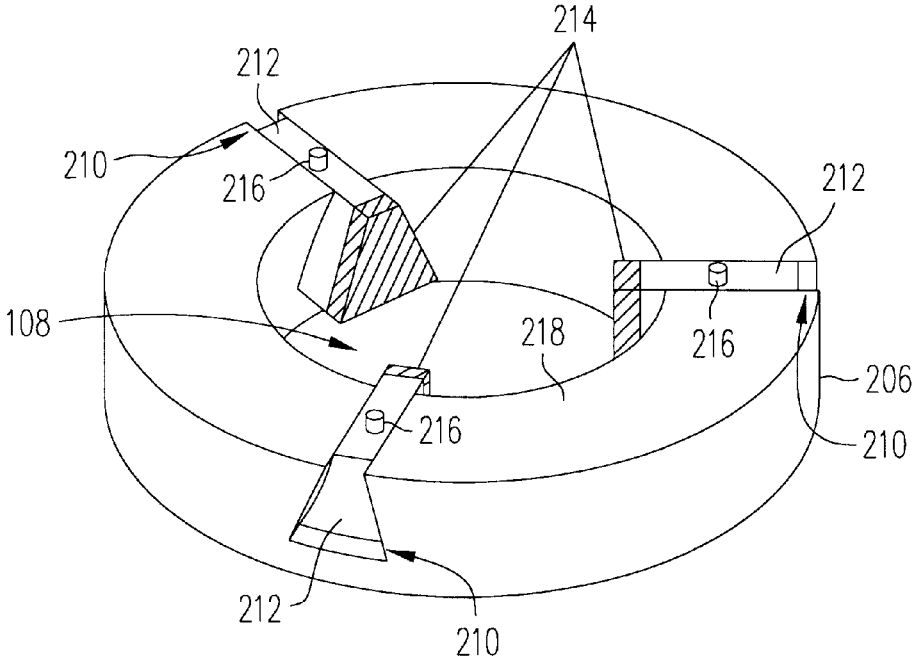

FIG. 7 is a top perspective view of pipe cleaner 200 in accordance with another embodiment of the present invention. Pipe cleaner 200 includes a body 206, which is similar to body 106 in size and manufacture, except grooves 210 within body 206 are beveled and body 206 does not include bores 107. Grooves 210 are beveled such that the width of grooves 210 at the top surface 218 is less than the width at the bottom of the grooves 210. Arms 212, which are correspondingly beveled, are slidably engaged with grooves 210, such that arms 212 can only be removed by sliding arms 212 outward from grooves 210, i.e., arms 212 cannot be lifted upwardly out of grooves 210. Arms 212 include pegs 216 that engage corresponding angled slots 124 in cover 220. Pegs 216, for example, may be screws or bolts that extend through angled slots 124 and are screwed into arms 212, thereby rotatably mounting cover 220 to body 206. Advantageously, by using pegs 216 to mount cover 220 to body 206, the need for arcuate slots 126 and fastener elements 128, shown in FIG. 1, is obviated. If desired a single detent mechanism 228 can be used with cover 220 to lock the position of cover 220 relative to body 206. Detent mechanism 228 for example is a thumb screw that extends through cover 220 and into communication with body 206, exerting a downward pressure on body 206 to prevent cover 220 from rotating relative to body 206.

Figure 8:
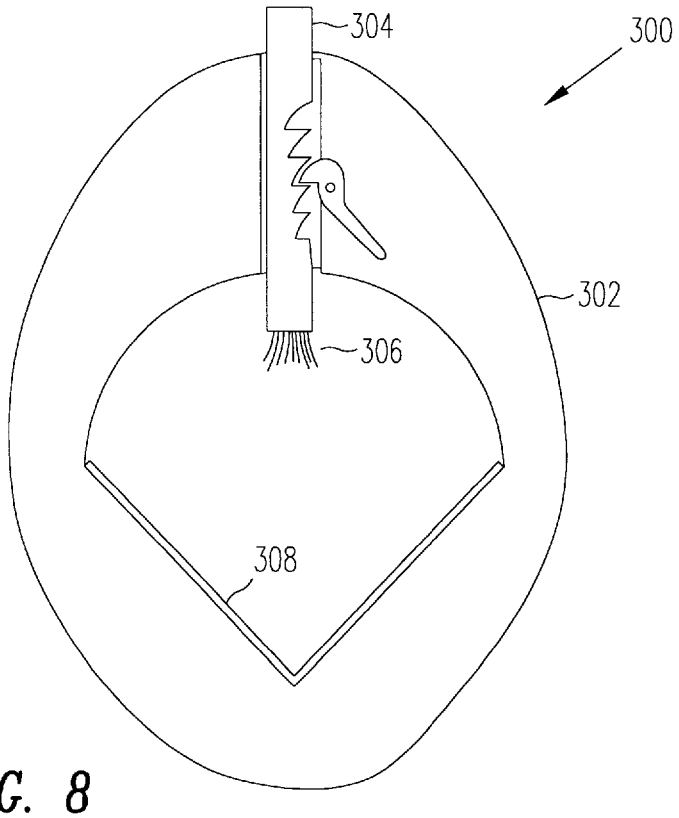
FIG. 8 is a top plan view of a pipe cleaner having a single arm with an abrasive member in opposition with a "V" shaped groove in accordance with another embodiment of the present invention.

FIG. 8 is a top plan view of a body 302 of a pipe cleaner 300 in accordance with an alternative embodiment of the present invention. Pipe cleaner 300 includes an arm 304 on which is mounted an abrasive member 306. Arm 304 is slideably engaged in a slot in body 302 and is adjusted inward and outward with a cover (not shown), similar to cover 120 shown in FIGS. 1 and 4 but having only one angled slot 124. Alternatively, arm 304 is slideably engaged in a bore through body 302 and is prevented from slipping out of position by a detent mechanism 305, such as a ball and spring mechanism, a ratchet system, a screw or bolt, or any other appropriate device. A "V" shape block 308 opposes arm 304, such that a pipe can be inserted and held firmly between V block 308 and arm 304. If desired abrasive members may be mounted on V block 308. Body 302, similar to body 106 (shown in FIGS. 1, 2A and 2B), is manufactured from plastic, wood, metal, or any other appropriate rigid material, and arm 304 is likewise similar to arm 112 shown in FIGS. 3A and 3B. The V block 308 is also made of a rigid material, such as plastic, and may be integrally formed on body 302 or connected via screw, bolt, glue or any other appropriate manner.

Figure 9:
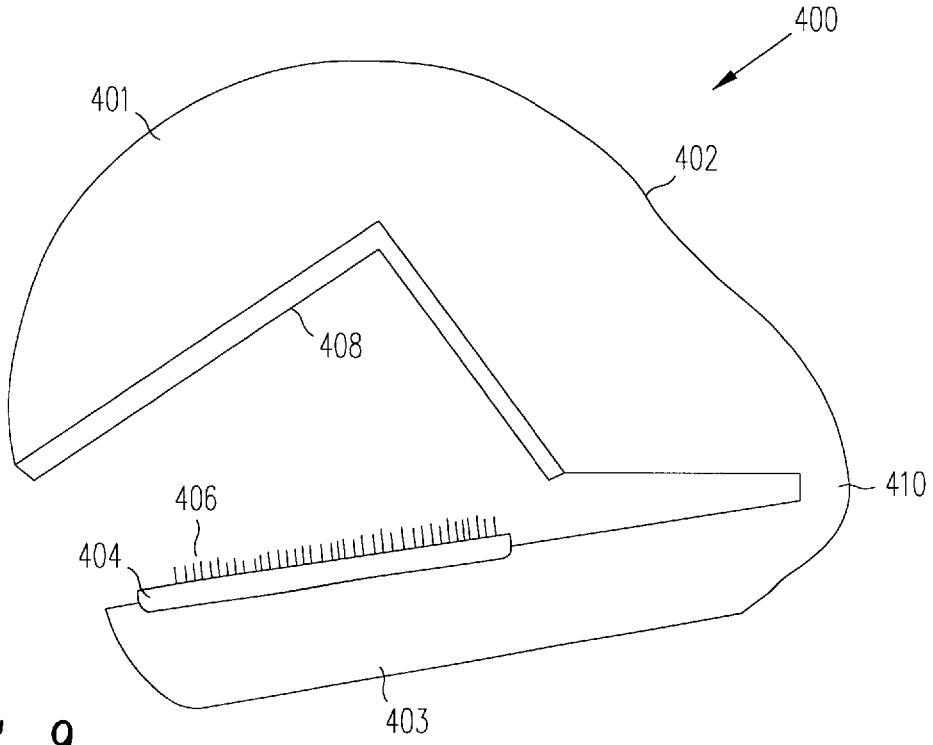
FIGS. 9 through 12 are top plan views of pipe cleaners having a single arm with an abrasive member and a "V" shaped groove mounted on opposing jaws in accordance with another embodiment of the present invention.

FIG. 9 is a top plan view of a body 402 of a pipe cleaner 400 in accordance with an alternative embodiment of the present invention. Body 402 includes two jaws, 401 and 403 upon which is mounted, respectively, a V block 408 and a beam 404 on which is mounted abrasive member 406. The V block 408 is similar to V block 308, described in reference to FIG. 8. Beam 404 may be manufactured from plastic or wood and is removably mounted on body 402. Body 402 is manufactured from deformable rubber, plastic, or a rigid type material that is flexible at pivot point 410. Alternatively, a hinge may be used at pivot point 410 so that jaws 401 and 403 may be adjusted to alter the relative position between V block 408 and the abrasive member 406 so that differing pipe diameters may be accommodated, as well as to place abrasive member 406 in firm contact with the threads of a pipe.

Figure 10:
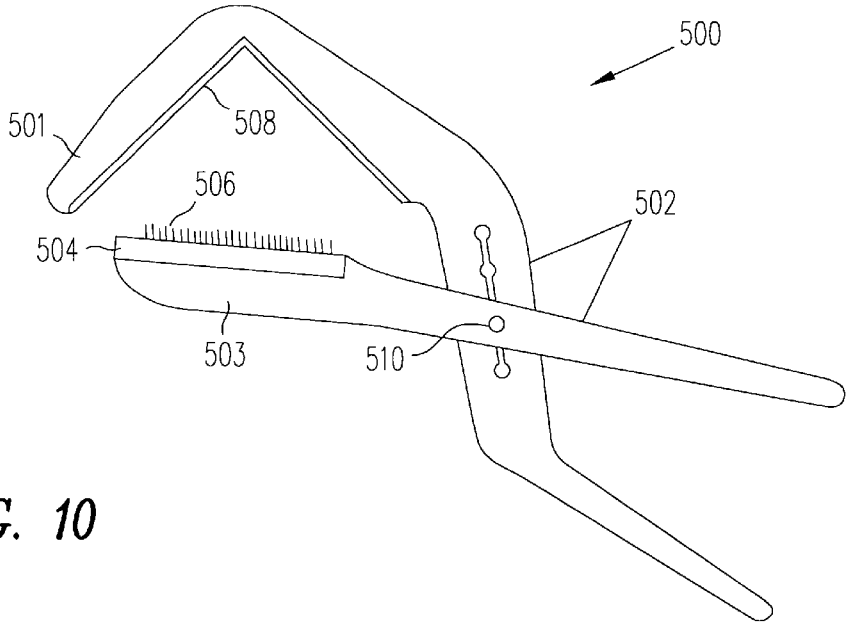

FIG. 10 is a plan view of pipe cleaner 500 in accordance with another embodiment of the present invention. As shown in FIG. 10, pipe cleaner 500 is similar to pliers, such as adjustable pliers, channel locks, or water pump pliers, with a V block 508 on one jaw 501 and beam 504 with abrasive member 506 on the opposing jaw 503. The body 502 of pipe cleaner 500 is manufactured from metal, such as aluminum or steel with V block 508 integrally or removably mounted thereon. The V block 508 is similar to V block 308 described in FIG. 8. Beam 504 is removably mounted on body 502 and is similar to beam 404 described in FIG. 9. The adjustable action of pipe cleaner 500 advantageously permits accommodation of pipes with differing diameters. An adjustable hinge 510 permits jaws 501 and 503 to be adjusted to alter the relative position between abrasive member 506 and V block 508 so as to place abrasive member 506 in firm contact with the threads of a pipe, and allows for different sizes of pipe.

Figure 11:
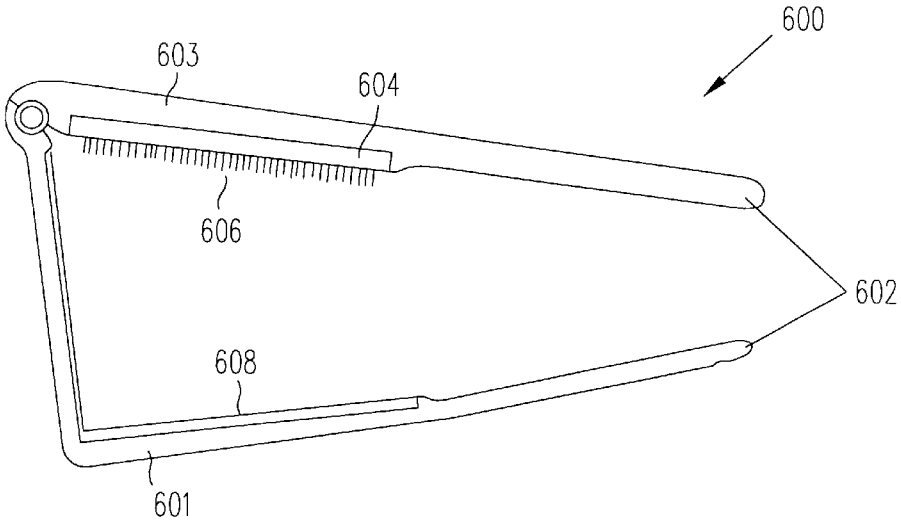
Figure 12:
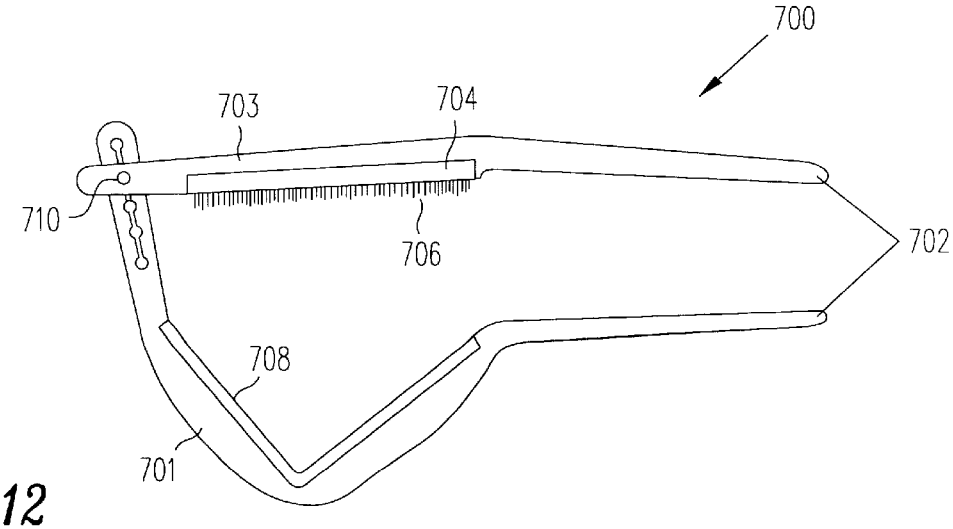

FIGS. 11 and 12 are plan views of pipe cleaners 600 and 700, respectively, in accordance with another embodiment of the present invention. Pipe cleaner 600 includes a V block 608 and beam 604 with abrasive member 606 mounted on jaws 601 and 603, respectively, of body 602. Similar to pipe cleaner 500 described in FIG. 10, the body 602 of pipe cleaner 600 is manufactured from metal, such as aluminum or steel with V block 608 integrally or removably mounted thereon. The V block 608 is similar to V block 308 described in FIG. 8. Beam 604 is removably mounted on body 602 and is similar to beam 404 described in FIG. 9. A hinge 610 permits jaws 601 and 603 of body 602 to be closed so that opposing V block 608 and beam 604 tightly contact the pipe to be cleaned.

Pipe cleaner 700 is similar to pipe cleaner 600, with opposing V block 708 and beam 704 with abrasive member 704 mounted on jaws 701 and 703, respectively, of body 702. However, pipe cleaner 700 includes an adjusting mechanism to join the arms of body 702. Thus, pipe cleaner 700 can be adjusted to accommodate pipes with greatly differing diameters. Similar to pipe cleaner 600 of FIG. 11, jaws 701 and 703 may be closed via a hinge 710.

Although the present invention has been described in considerable detail with reference to certain versions thereof, other versions are possible. Therefore, the spirit and scope of the appended claims should not be limited to the description of the versions depicted in the figures.

What is claimed is:

1. A method of cleaning the threads of a pipe, said method comprising:

sliding an arm having an abrasive member at an end towards a "V" shaped block inserting a pipe with threads between said abrasive member and said "V" shaped block, wherein said abrasive member is engaged with said threads on said pipe; and rotating at least one of said pipe and said pipe cleaner relative to each other.

2. The method of claim 1, wherein inserting a pipe is performed before sliding an arm having an abrasive member at an end towards a "V" shaped block.

3. The method of claim 1 further comprising preventing said arm from slipping out of position relative to said "V" shaped block to hold said threads of said pipe between said abrasive member and said "V" shaped block.

4. A pipe cleaner comprising:

means for holding at least one abrasive member in contact with threads on a pipe; and means for manually adjusting the position of said abrasive member relative so as to accommodate pipes of differing diameters;

wherein said means for holding at least one abrasive member in contact with threads on a pipe comprises a body of a pipe cleaner having a "V" shaped block opposing said abrasive member, said abrasive member being mounted on an arm that is slidably engaged in said body so that said arm may be slid to hold said threads on said pipe between said "V" shaped block and said abrasive members on said arm.

5. The pipe cleaner of claim 4, wherein said means for holding at least one abrasive member in contact with threads on a pipe comprises a body of a pipe cleaner having a groove into which is slidably engaged an arm on which is said abrasive member, said body having an orifice into which said abrasive member on said arm extends so as to contact threads on said pipe when said pipe is inserted into said orifice.

6. The pipe cleaner of claim 4, wherein said means for holding at least one abrasive member in contact with threads on a pipe further comprises a means for detention of said arm.

7. The pipe cleaner of claim 6, wherein said means for detention of said arm comprises a ratchet for preventing said arm from slipping.

8. A pipe cleaner comprising:

a body;

a V shaped block mounted on said body;

an abrasive member coupled to said body, the position of said abrasive member relative to said V shaped block being adjustable, said abrasive member is coupled to a slidable arm opposing said V shaped block; and a detent mechanism for preventing said slidable arm from slipping out of position relative to said V shaped block.

9. The pipe cleaner of claim 8, wherein:

said body defines an orifice; and said abrasive member is mounted on an end of an arm slideably engaged with said body, said end of said arm extending into said orifice.

10. The pipe cleaner of claim 8, wherein said detent mechanism is a ratchet.

* * * * *